United States Patent [19]

Wise

[11] 4,145,856

[45] Mar. 27, 1979

[54] TOLERANCE ADJUSTMENT DEVICE

[76] Inventor: William D. Wise, P.O. Box 29, Genoa, Nev. 89411

[21] Appl. No.: 731,529

[22] Filed: Oct. 12, 1976

[51] Int. Cl.[2] ..... E04B 2/28; E04B 1/40

[52] U.S. Cl. ..... 52/285; 52/127; 52/227; 52/240; 52/584

[58] Field of Search ..... 52/127, 285, 584, 122, 52/126, 278, 627, 632, 227, 240, 217, 207

[56] References Cited

U.S. PATENT DOCUMENTS

| | | | |
|---|---|---|---|
| 1,458,025 | 6/1923 | Biele | 52/217 |
| 1,990,259 | 2/1935 | Walters | 52/240 |
| 2,443,548 | 6/1948 | Wilson | 52/217 X |
| 2,540,468 | 2/1951 | Anderson | 52/584 X |
| 2,568,133 | 9/1951 | Swisher, Sr. et al. | 52/127 X |
| 3,133,322 | 5/1964 | Douglas | 52/127 X |
| 3,175,652 | 3/1965 | Brekell et al. | 52/127 |
| 3,264,019 | 8/1966 | Houvener et al. | 52/127 |
| 3,305,983 | 2/1967 | Bus | 52/127 |
| 3,340,655 | 9/1967 | Darrah, Jr. | 52/127 X |
| 3,411,252 | 11/1968 | Boyle, Jr. | 52/122 |
| 3,566,559 | 3/1971 | Dickson | 52/122 |
| 3,868,800 | 3/1975 | Peterson | 52/285 |
| 3,885,361 | 5/1975 | De Schutter | 52/122 |

FOREIGN PATENT DOCUMENTS

| | | | |
|---|---|---|---|
| 1033880 | 7/1958 | Fed. Rep. of Germany | 52/122 |
| 2405009 | 8/1975 | Fed. Rep. of Germany | 52/127 |
| 292332 | 7/1965 | Netherlands | 52/122 |

*Primary Examiner*—Leslie Braun

*Attorney, Agent, or Firm*—Donald C. Feix

[57] ABSTRACT

A tolerance adjustment device maintains tolerances in the assembly of building panels. The tolerance adjustment device comprises a panel section which is aligned with an end edge of one building panel. An adjustment bolt moves the panel section toward and away from the end edge of the building panel to form a variable length extension of that panel which compensates for tolerance variations along the length of an assembly of the building panels.

2 Claims, 2 Drawing Figures

TOLERANCE ADJUSTMENT DEVICE

BACKGROUND OF THE INVENTION

This invention relates to a tolerance adjustment device. It relates particularly to a tolerance adjustment device for use with building panels of the kind in which each panel is a double walled structure formed by two outer side walls and channels which form a peripheral frame. In building panels of this kind the interior of the panel may be filled with a core material, such as foam, to form a laminated structural panel, and adjacent panels are interlocked to form apparently seamless walls, floors, and roofs.

In buildings constructed from building panels of this kind the panels are modular panels of standard dimensions, and the channels which make up the perimeter frames of each building panel have special configurations for permitting two adjacent building panels to be interlocked through adjacent channels along the adjoining edges of the panels. Locking devices coact with the channels to retain the adjoining edges of the panels tightly locked together after the building panels have been assembled in place.

Maintaining required building tolerances at corner connections and butt wall connections can be a problem with modular building panels of this kind since there can be a stack-up of individual panel dimensional variations (even though each individual panel itself is within standard tolerances). This is especially true in long spans where a relatively large number of individual building panels are connected together end to end to form a wall, floor or roof.

Since the channel members which form the peripheral frame are integral and necessary parts of each panel, the builder cannot just saw off part of one building panel (as is the case when the builder is using conventional building materials such as two by four wood framing and plywood or gypsum board surface paneling) if some of the assembled walls, floors, etc., turn out to be too long.

It is a primary object of the present invention to maintain tolerances in the assembly of building panels by a tolerance adjustment device which moves a panel section toward and away from an end of a building panel as required to compensate for tolerance variations in a building wall, floor or roof constructed from an assembly of such modular building panels.

SUMMARY OF THE INVENTION

The tolerance adjustment device of the present invention includes a panel section which is aligned with an end of a building panel. An adjustment bolt interconnects the panel section and the building panel and moves the panel section toward or away from the end of the building panel, depending upon the direction of rotation of the bolt, to compensate for tolerance variations along the length of an assembly of building panels.

Each building panel comprises two laterally spaced walls forming the side surfaces of the building panel, and peripheral channels form a perimeter frame for each building panel.

The panel section also has two laterally spaced wall sections which are aligned with the walls of the building panel. The panel section also has a channel which forms a frame for the panel section.

The adjustment bolt is mounted for rotation in the channel of the panel section but is held against any axial movement with respect to the panel section by a washer and pin connection. The washer and the under side of the bolt head engage opposite surfaces of the channel web, or a mounting plate welded within the channel, of the panel section to hold the bolt in a fixed axial position with respect to the panel section, regardless of which way the adjustment bolt is turned.

A threaded end of the adjustment bolt extends toward the related building panel, and this threaded end of the adjustment bolt is engaged in a threaded opening in a plate connected to the channel of the building panel.

Thus, as the bolt is rotated in one direction or the other, the panel section is moved axially toward or away from the adjacent edge of the building panel, to the extent of the travel permitted by the threaded end of the adjustment bolt.

The panel section may be attached to either a butt wall or a right angle wall. One or two auxiliary wall boards are used, as required, to enclose the space between the building panel and the panel section.

When the tolerance adjustment device has been adjusted and locked into its desired position, structural foam, cement or plastic may be placed within the space between the tolerance adjustment device and the adjacent building panel so that the tolerance adjustment device becomes a durable and fixed part of the building panel.

Tolerance adjustment device apparatus and methods which incorporate the structure and techniques described above and which are effective to function as described above constitute specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DESCRIPTION OF THE PREFERRED EMBODIMENTS

Figure 1:
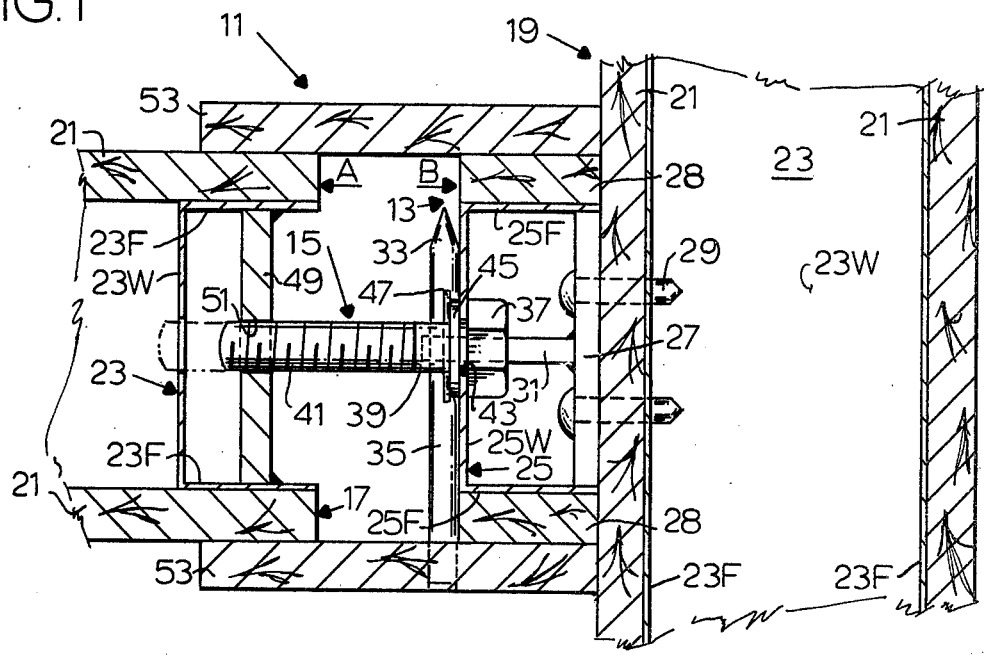
FIG. 1 is a plan view in cross section of a tolerance adjustment device constructed in accordance with one embodiment of the present invention.

A tolerance adjustment device constructed in accordance with one embodiment of the present invention is indicated generally by the reference numeral 11 in FIG. 1.

The tolerance adjustment device comprises a panel section 13 and an adjustment bolt 15 for moving the panel section 13 (as indicated by the arrows A and B) toward and away from an adjacent end of a building panel 17.

In the FIG. 1 embodiment the building panel 17 is connected to another building panel 19 in a butt joint by means of the tolerance adjustment device 11. However, as will become more apparent from the description to follow, the structure shown in FIG. 1 can also be used to make a right angle connection.

Each of the building panels 17 and 19 comprise two laterally spaced walls 21 and peripheral channels 23 which form perimeter frames for the building panels. The channels 23 shown in FIG. 1 are female channels in which the web 23W is spaced inward from the end edge of the panel by the length of the side flanges 23F of the channel.

Though not shown in the drawings, each building panel 17 and 19 is preferably a laminated structural panel having a core, such as foam, concrete or the like, adhered to the inner surfaces of the outer walls 21.

The panel section 13 comprises a channel 25 having a web 25W and two side flanges 25F. The channel 25 forms a frame for the panel section 13, and side wall sections 28 are attached to the side flanges 25F and are aligned with the side walls 21 of the building panel 17.

The panel section 13 thus serves as a variable length extension of the building panel 17 to compensate for tolerance variations along the length of an assembly of the building panels 17.

To provide the desired relative positioning of the panel section 13 with respect to the building panel 17, a number of adjustment bolts 15 are located at intervals along the length of the panel section 13. Each adjustment bolt 15 comprises a bolt head 37 and a bolt shank 39 having a threaded outer end 41. The bolt shank extends through an opening 43 in the channel web 25W.

The adjustment bolt 15 is freely rotatable in the opening 43 but is held against any axial movement with respect to the panel section 13. The underside of the bolt head 37 engages the inside surface of the web 25 to prevent any movement of the bolt outward of the panel section, and a washer 45 and pin 47 prevent the bolt from moving inward with respect to the panel section 13.

A plate 49 is welded to the side flanges 23F of the female channel 23 of the building panel 17, and the threaded end 41 of the bolt engages a corresponding threaded opening 51 in the plate 49.

In operation, as the adjustment bolt 15 is turned clockwise the distance between the panel section 13 and the building panel 17 is descreased, and as the adjustment bolt 15 is turned counterclockwise, the distance is increased.

In the embodiment shown in FIG. 1 the panel section 13 is locked to the building panel 19 after the panel section 13 has been positioned (as described above) with respect to the building panel 17.

The locking mechanisms for locking the panel section 13 to the building panel 19 comprise a receiver 27 which is attached to the building panel 19 by screws 29 which extend through the side wall 21 and flange 23F. A locking lug 31 projects outward from the receiver 27 and through a related opening (not shown in FIG. 1 because it is behind adjustment bolt 15) in the flange 25W. The part of the locking lug 31 which projects beyond the flange 25W has a pin receiving hole extending through the lug. The hole in the locking lug extends far enough outward beyond the flange 25W to admit a tapered end 33 of the locking pin 35 to enter the hole but not far enough to admit the full diameter of the pin. The locking pin is then driven into the hole in the locking lug on the outer side of the web 25 of the channel to pull the locking lug outward with respect to the channel web by a slight outward flexure of the receiver 27 and inward flexure of the web 25. The elastic flexure of the locking device retains the panel section 13 in tightly locked engagement with the building wall 19 during all subsequent conditions of thermal expansion and contraction.

A number of the pin over channel and through the lug type of locking devices are used along the length of the panel section 13.

At this point then in the assembly of the structure shown in FIG. 1 the panel section 13 has been positioned with respect to the panel 17 and then securely attached to the building panel 19.

The space between the end of the building panel 17 and the panel section 13 is enclosed by auxiliary wall boards 53. In the embodiment of the invention shown in FIG. 1 the lower wall board 53 is put in place prior to driving locking pin 35 through the opening in the lug 31, and the locking pins are actually driven directly through the lower wall board 53 at predetermined positions corresponding to the pin receiving holes in the locking lugs 31.

When the tolerance adjustment device 11 has been adjusted to its desired position, structural foam, cement or plastic may be placed in the space between the tolerance adjustment device and the adjacent building panel 17 so that the tolerance adjustment device becomes a durable and fixed part of the building panel.

Figure 2:
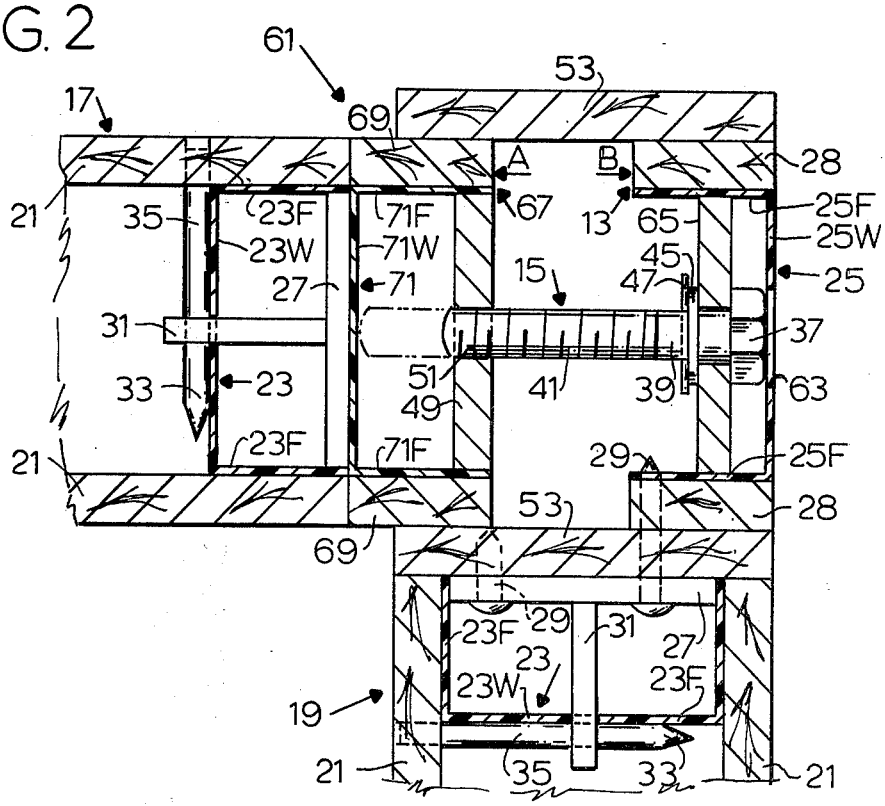
FIG. 2 is a plan view in cross section of a tolerance adjustment device constructed in accordance with another embodiment of the present invention.

FIG. 2 shows another embodiment of a tolerance adjustment device constructed in accordance with the present invention. The embodiment of the tolerance adjustment device shown in FIG. 2 is indicated generally by the reference numeral 61.

Parts in FIG. 2 which correspond to like parts in FIG. 1 have been designated by the same reference numerals.

In the FIG. 2 embodiment, the building panel 17 is connected to the building panel 19 in a right angle connection by the tolerance adjustment device 61.

The primary difference between the FIG. 2 and FIG. 1 embodiments is the fact that in the FIG. 1 embodiment the panel section 13 is locked to a side of the building panel 19, and in the FIG. 2 embodiment the panel section 13 is locked to an end of the building panel 19. Therefore, in the FIG. 2 embodiment the panel section 13 is positioned so that the web 25W of the channel (which can be a plastic channel as shown in FIG. 2 or a metal channel as shown in FIG. 1) forms a smooth outside surface (except for an opening 63 which permits adjustment of the adjustment bolt 15 and which is later covered over) which serves as extension of the outer surface of the wall 21 of the lower building panel 19.

A plate 65 is attached across the side flanges 25F and provides the opening 43 for rotation of the bolt shank 35.

A tolerance adjustment device 61 of FIG. 2 includes an adapter panel section 67 having two outer panel sections 69 and a channel 71 with a web 71W and two side flanges 71F. The channel 71 serves as a male channel, and a number of locking devices each having a receiver 27, locking lug 31 and locking pin 35 are used to lock the adapter panel 67 to the end of the building panel 17. The receiver 27 is welded or otherwise connected to the web 71 so that when the pin 35 is driven through the locking lug the male channel 71 of the adapter panel 67 is drawn into locking engagement with the female channel 23 of the building panel 17 as described above with reference to the corresponding locking devices of FIG. 1. The right hand fastener 29, as viewed in FIG. 2, connects the receiver 27 of the lower fastener shown in FIG. 2 to the panel section 13.

The panel section 13 is adjusted to the desired position with respect to the building panel 17, the left hand fastener 29 is then put into place, and the building panel 19 is locked into position by driving the locking pins 35 through the related locking lugs 31 to complete the assembly of the right angle wall shown in FIG. 2.

While tolerance adjustment devices of the present invention have been shown in association with vertically extending walls, the tolerance adjustment devices are also usable to maintain tolerances in assembled building panels used in floors, roofs, and the like.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A tolerance adjustment device for maintaining tolerances in the assembly of building panels, said tolerance admustment device comprising, a building panel, a panel section aligned with an end edge of the building panel, adjustment bolt means for moving said panel section toward and away from end edge of the building panel to form a variable length extension of that building panel which compensates for tolerance variations along the length of an assembly of such building panels, said building panel comprising two laterally spaced walls forming side surfaces of the building panel and a channel member which forms a perimeter frame, said channel member being a female channel in the edge of the building panel which faces the panel section, said panel section comprising two apaced apart wall sections aligned with the walls of the building panel and a channel member which forms a frame for the panel section, said adjustment bolt means including a plate connected between the flanges of the female channel of the building panel and formed with a threaded opening, the channel of the panel section having a web formed with an opening for a bolt shank, the adjustment bolt means including a bolt mounted for rotation in the opening of the web of the panel section channel with the undersurface of the head of the bolt engageable with the web around the opening, said adjustment bolt means further including a washer encircling the bolt shank on the side of the web opposite that engaged by the bolt head and a pin extending through the bolt and engageable with the washer on the face of the washer opposite that engaged with the web of the panel section channel so that the bolt is held against any axial movement with respect to the panel section, and wherein the bolt has a threaded end engaged in a threaded opening of said plate connected to the building panel channel so that rotation of the bolt moves the panel section toward and away from the building panel depending upon the direction of the rotation of the bolt to provide both plus and minus adjustment of the panel section with respect to the building panel and to therby provide adjustments for maintaining required tolerances in the assembly of the building panels.

2. A tolerance adjustment device for maintaining tolerances in the assembly of building panels, said tolerance adjustment device comprising, a panel section aligned with an end edge of the building panel, and adjustment bolt means for moving said panel section toward and away from said end edge to form a variable length extension of that panel which compensates for tolerance variations along the length of an assembly of such building panels and wherein the building panel comprises two laterally spaced walls forming side surfaces of the building panel and a channel member which forms a perimeter frame and wherein the panel section comprises two spaced apart wall sections aligned with the walls of the building panel and a channel member which forms a frame for the panel, second plate means connected to the channel of the panel section and formed with an opening for a bolt shank, and a bolt mounted for rotation in the second plate means but held against any axial movement with respect to the second plate means and having a threaded end engaged in the threaded opening of a first plate means which are so associated with the building panel that rotation of the bolt moves the panel section toward and away from the building panel depending upon the direction of the rotation of the bolt and wherein the channel of the building panel is a female channel and said tolerance adjustment device further including an adapter panel section connected to the end of the building panel and having two wall sections laterally spaced apart and aligned with the walls of the building panel and a male channel connected to the female channel of the building panel and including a locking lug connected to the male channel of the adapter panel section and extending through an opening in the web of the female channel and having a pin receiving opening in the outer end of the locking lug and a locking pin driven through the lug opening and along the back of the web of the female channel to lock the adapter panel section to the building panel and wherein the adapter section includes the first plate means connected to the side flanges of the male channel of the adapter panel section.

* * * * *